US010294594B2

(12) United States Patent
Meir

(10) Patent No.: US 10,294,594 B2
(45) Date of Patent: May 21, 2019

(54) KNITTING MACHINE WITH A SINKER AND BIASED CAM MEMBER FOR ACTUATING THE SINKER

(71) Applicant: NIKE, Inc., Beaverton, OR (US)

(72) Inventor: Adrian Meir, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/659,124

(22) Filed: Jul. 25, 2017

(65) Prior Publication Data

US 2017/0321358 A1 Nov. 9, 2017

Related U.S. Application Data

(63) Continuation of application No. PCT/US2016/015126, filed on Jan. 27, 2016.

(60) Provisional application No. 62/108,625, filed on Jan. 28, 2015.

(51) Int. Cl.

| | |
|---|---|
| ***D04B 15/36*** | (2006.01) |
| ***D04B 15/70*** | (2006.01) |
| ***D04B 15/90*** | (2006.01) |
| ***D04B 15/06*** | (2006.01) |

(52) U.S. Cl.

CPC ..... *D04B 15/362* (2013.01); *D04B 15/06* (2013.01); *D04B 15/70* (2013.01); *D04B 15/90* (2013.01)

(58) Field of Classification Search

CPC ..... D04B 15/06; D04B 15/362; D04B 15/70
USPC ..... 66/104, 105, 106, 109
See application file for complete search history.

(56) References Cited

U.S. PATENT DOCUMENTS

| | | | | |
|---|---|---|---|---|
| 2,067,877 A * | 1/1937 | Lawson | D04B 9/38 | 66/223 |
| 2,123,534 A | 7/1938 | Lawson et al. | | |
| 5,134,865 A * | 8/1992 | Shima | D04B 15/06 | 66/104 |
| 5,333,473 A * | 8/1994 | Miyamoto | D04B 15/06 | 66/106 |

(Continued)

FOREIGN PATENT DOCUMENTS

| | | |
|---|---|---|
| CN | 101962866 A | 2/2011 |
| EP | 1 522 617 A1 | 4/2005 |
| EP | 1 956 126 A1 | 8/2008 |

OTHER PUBLICATIONS

International Search Report and Written Opinion dated Apr. 21, 2016 for PCT Application No. PCT/US2016/015126 (15 pp.).

(Continued)

*Primary Examiner* — Danny Worrell
(74) *Attorney, Agent, or Firm* — Brinks Gilson & Lione

(57) ABSTRACT

A knitting machine may include a sinker configured to move between an open position and a closed position. The knitting machine may have a sinker actuator system having a first configuration and a second configuration. The sinker actuator system, in the first configuration, may be configured to actuate the sinker from the open position toward the closed position. The sinker may be configured to change the sinker actuator system from the first configuration to the second configuration when the sinker receives an input force above a predetermined threshold in the movement from the open position toward the closed position. The sinker actuator system, in the second configuration, may allow the sinker to move away from the closed position toward the open position.

16 Claims, 15 Drawing Sheets

(56) References Cited

U.S. PATENT DOCUMENTS

| | | | | |
|---|---|---|---|---|
| 5,475,991 | A * | 12/1995 | Yabuta | D04B 15/06 66/106 |
| 6,079,233 | A * | 6/2000 | Shima | D04B 15/06 66/106 |
| 7,380,419 | B2 * | 6/2008 | Miyamoto | D04B 15/06 66/106 |
| 2006/0243001 | A1 | 11/2006 | Sonomura et al. | |

OTHER PUBLICATIONS

International Preliminary Report on Patentability in corresponding International Application No. PCT/US2016/015126, dated Aug. 10, 2017, 12 pages.

* cited by examiner

KNITTING MACHINE WITH A SINKER AND BIASED CAM MEMBER FOR ACTUATING THE SINKER

RELATED APPLICATIONS

This application claims is a continuation of International Application No. PCT/US2016/015126, filed Jan. 27, 2016, which claims the benefit of priority of U.S. Provisional Application Ser. No. 62/108,625, filed Jan. 28, 2015. These applications are both hereby incorporated by reference in their entireties.

BACKGROUND

The present disclosure relates generally to a knitting machine and, more particularly, relates to a knitting machine with a biased cam member for actuating a sinker.

Various knitting machines have been developed that can automate the knitting process. For example, knitting machines can include a plurality of knitting needles, a carriage, and one or more feeders. The carriage can move the feeder relative to the needles as the feeder feeds yarn toward the needles. The needles can, in turn, form the knitted component from the yarn. These actions can repeat until the knitted component is fully formed.

Knitting machines can also include sinkers that perform various functions during the knitting process. For example, sinkers can assist in formation of loops from the yarn. Sinkers can also hold down formed loops of the knitted component as the needles add new loops to the component. Moreover, sinkers can perform so-called "knock over," in which the sinker supports a previously-formed loop as a new loop is drawn through the previously-formed loop.

BRIEF DESCRIPTION

In one general aspect, an embodiment of a knitting machine for knitting a knitted component is disclosed. The knitting machine includes a sinker configured to move between an open position and a closed position. The knitting machine also includes a sinker actuator system having a first configuration and a second configuration. The sinker actuator system, in the first configuration, is configured to actuate the sinker from the open position toward the closed position. Also, the sinker is configured to change the sinker actuator system from the first configuration to the second configuration when the sinker receives an input force above a predetermined threshold in the movement from the open position toward the closed position. The sinker actuator system, in the second configuration, allows the sinker to move away from the closed position toward the open position.

The knitting machine may have a yarn feeder, where a first ramped surface of the yarn feeder is configured to contact the sinker to provide the input force when the sinker impacts the yarn feeder. The sinker may have a second ramped surface configured to contact the yarn feeder when the sinker impacts the yarn feeder.

In another general aspect of the present disclosure, an embodiment of a includes a sinker configured to move between an open position and a closed position. The knitting machine further includes a sinker cam assembly configured to actuate the sinker between the open position and the closed position. The sinker cam assembly includes a cam member configured to move between a first position and a second position. The sinker cam assembly further includes a biasing member that biases the cam member toward the first position with a predetermined threshold force. The cam member, in the first position, is configured to move relative to the sinker to actuate the sinker away from the open position toward the closed position. Also, the cam member is configured to receive an input force from the sinker that moves the cam member away from the first position to the second position when the input force exceeds the predetermined threshold force, thereby allowing the sinker to move away from the closed position toward the open position.

In another general aspect of the present disclosure, a method of actuating a sinker of a knitting machine between an open position and a closed position with a cam assembly is disclosed. The method includes providing a cam member of the cam assembly configured to move between a first position and a second position. The method also includes biasing the cam member with a biasing member toward the first position with a predetermined threshold force. Moreover, the method includes moving the cam member relative to the sinker when the cam member is in the first position to move the sinker between the open position toward the closed position. Furthermore, the method includes moving the cam member relative to the sinker, causing the cam member to receive an input force from the sinker. Additionally, the method includes moving the cam member away from the first position to the second position when the input force exceeds the predetermined threshold force, thereby allowing the sinker to move away from the closed position toward the open position.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

DETAILED DESCRIPTION

The following discussion and accompanying figures disclose a variety of concepts relating to knitting machines, knitted components, and the manufacture of knitted components.

Various exemplary embodiments of a knitting machine are disclosed below. The knitting machine can include a plurality of sinkers that facilitate the knitting process. These sinkers can be mounted to the knitting machine for movement between an open position and a closed position. By moving toward the closed position, the sinker can assist in formation of loops during formation of a knitted component, can hold down previously-formed loops as new loops are added, and/or can perform "knock-over" and support a previously-formed loop as a new loop is drawn through the previously-formed loop.

The movement of the sinker can be predetermined and controlled by an actuator system. For example, the actuator system can include a cam assembly. As components of the cam assembly move, the cam assembly can actuate the sinker between its open and closed positions.

In some situations, the sinker can receive a load that transfers to the cam assembly. If the load exceeds a predetermined threshold, then the cam assembly can allow the sinker to move away from the closed position toward the open position. Also, the cam assembly can absorb and dampen forces from the sinker and also allow the sinker to move more freely under predetermined conditions. This can, in turn, allow for a wider range of uses of the knitting machine 100 and allow new types of knitted components to be produced.

Embodiments of Knitting Machine

Figure 1:
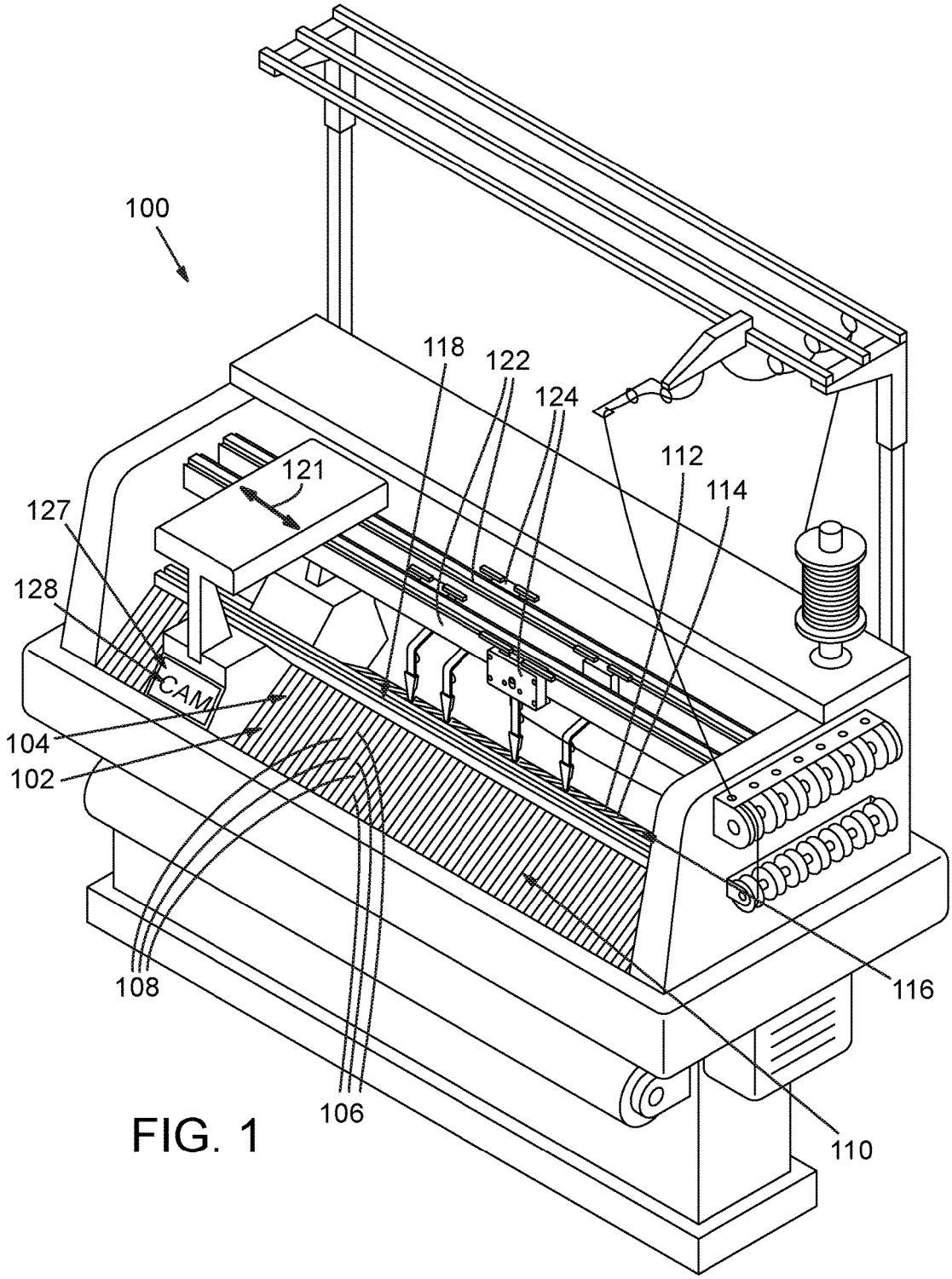
FIG. 1 is a perspective view of a knitting machine according to exemplary embodiments of the present disclosure.

Referring initially to FIG. 1, a knitting machine 100 is illustrated according to exemplary embodiments of the present disclosure. Knitting machine 100 can be of any suitable type, such as a flat knitting machine, a circular knitting machine, or other type. For example, knitting machine 100 of FIG. 1 has a configuration of a V-bed flat knitting machine as an exemplary embodiment. However, the knitting machine 100 can have different configurations without departing from the scope of the present disclosure.

Figure 3:
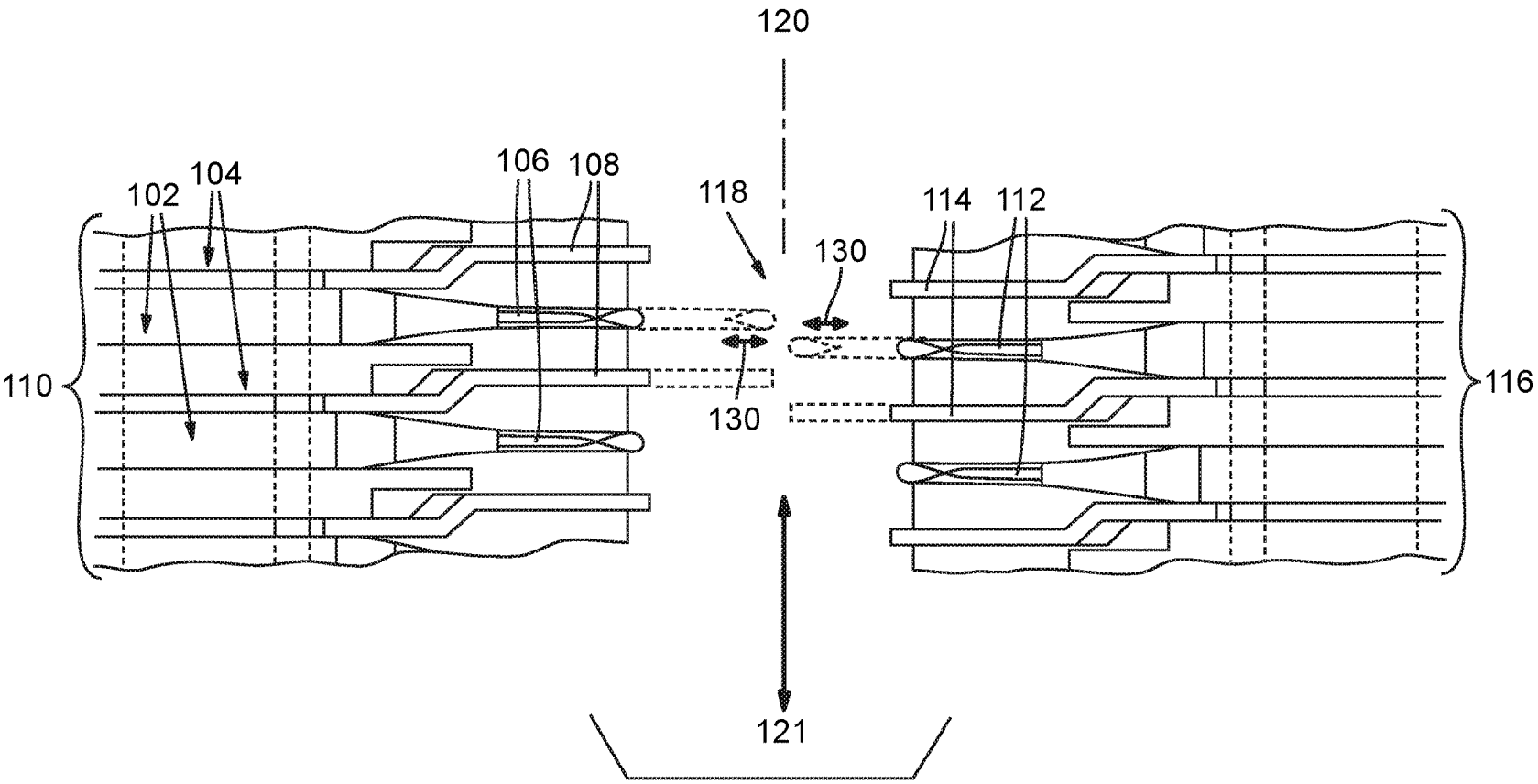
FIG. 3 is a top view of a needle bed of the knitting machine of FIG. 1.

Knitting machine 100 can include a plurality of needles 102 and a plurality of sinkers 104, which are illustrated schematically in FIG. 1 and in greater detail in FIG. 3. Needles 102 can include a plurality of first needles 106, and sinkers 104 can include a plurality of first sinkers 108. Needles 102 can further include a plurality of second needles 112 and a plurality of second sinkers 114.

First needles 106 and first sinkers 108 can be arranged generally in a first bed 110 of knitting machine 100. In some embodiments, first bed 110 can be substantially planar. As shown in FIG. 3, first needles 106 and first sinkers 108 can be disposed in an alternating arrangement within first bed 110. Similarly, second needles 112 and second sinkers 114 can be arranged in a second bed 116, which can be substantially planar in some embodiments. Also, second needles 112 and second sinkers 114 can be disposed in an alternating arrangement as shown in FIG. 3. It will be appreciated that first bed 110 can be referred to as a "front bed," and second bed 116 can be referred to as a "rear bed."

Figure 2:
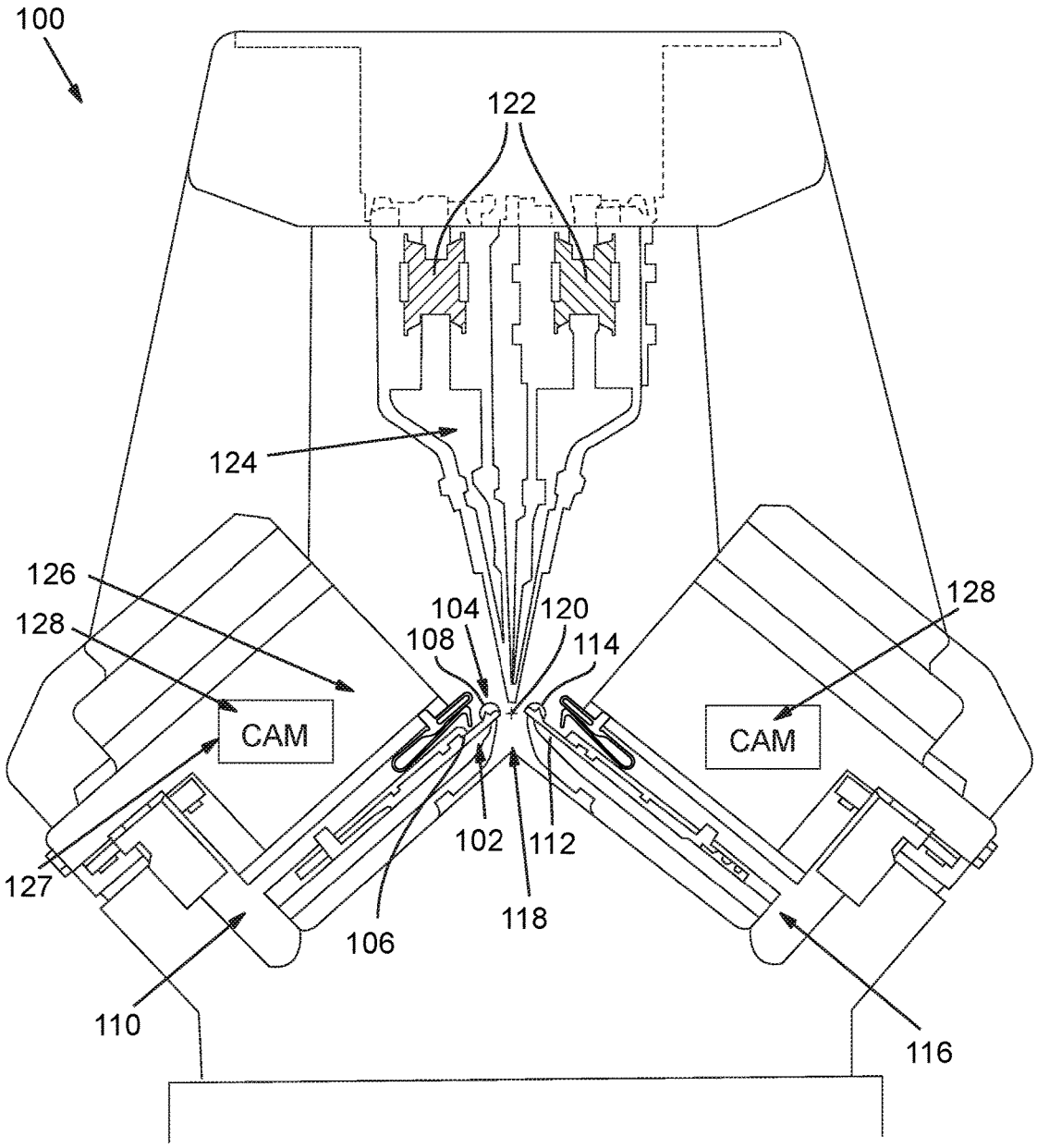
FIG. 2 is a schematic section view of the knitting machine of FIG. 1.

First bed 110 and second bed 116 can be spaced apart from each other as shown in FIGS. 1-3 to define a gap 118 between first and second beds 110, 116. Also, as shown in FIGS. 1 and 2, first bed 110 and second bed 116 can be angled relative to each other. As such, the plane of first bed 110 and the plane of second bed 116 can intersect at an intersection 120 (see FIGS. 2, 3 and 5) that extends along a longitudinal direction 121 of knitting machine 100.

As shown in FIGS. 1 and 2, knitting machine 100 can further include one or more rails 122. Rails 122 can be elongate and can extend substantially parallel to the longitudinal direction 121. Rails 122 can provide attachment points for one or more yarn feeders 124.

Feeders 124 can move longitudinally along the respective rail 122 while feeding yarn 125 toward needles 102. It will be appreciated that feeders 124 can be configured to feed any type of yarn, fiber, wire, cable, filament, or other strand toward needles 102.

Figure 4:
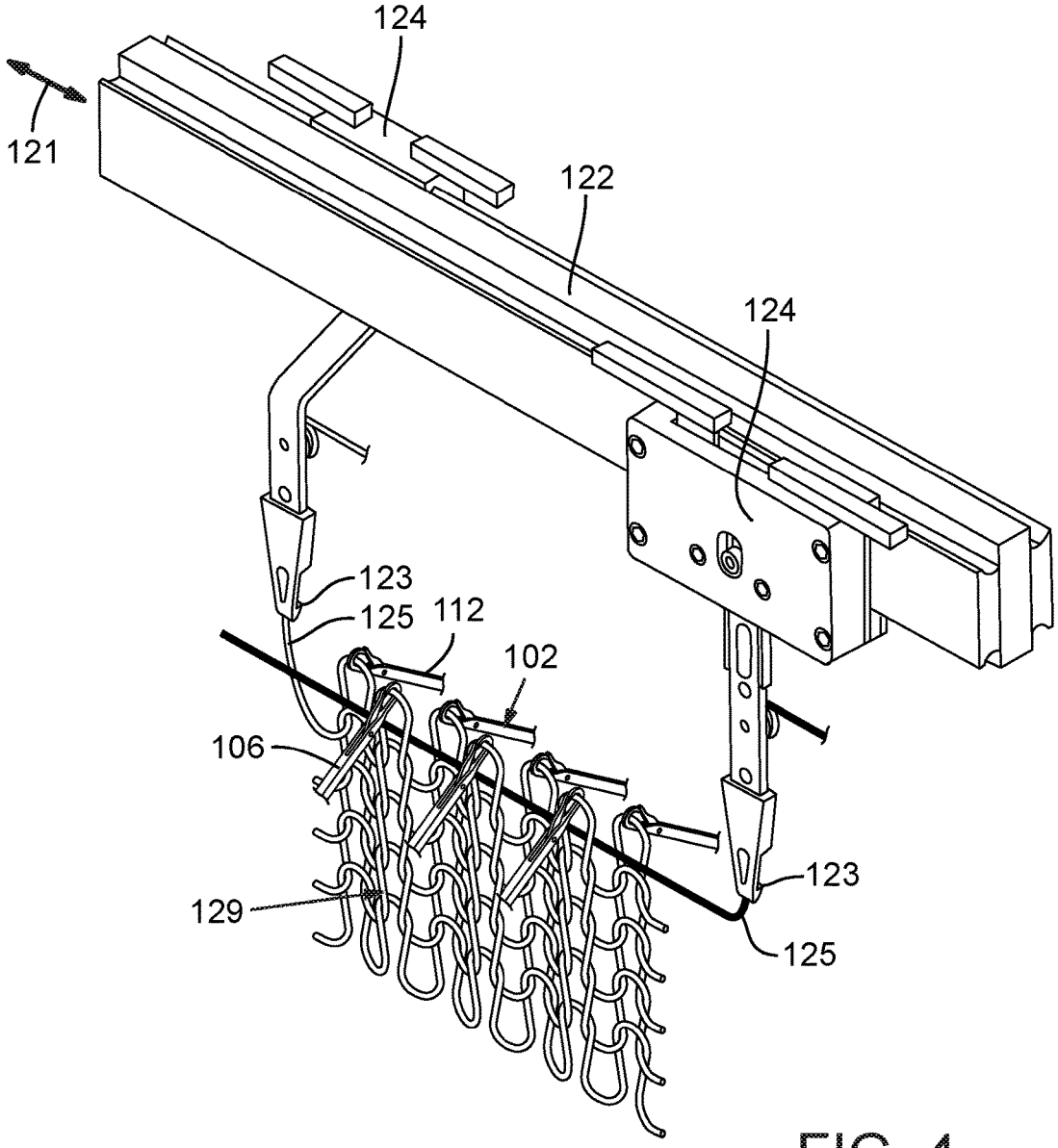
FIG. 4 is a perspective view of portions of the knitting machine of FIG. 1.
Figure 5:
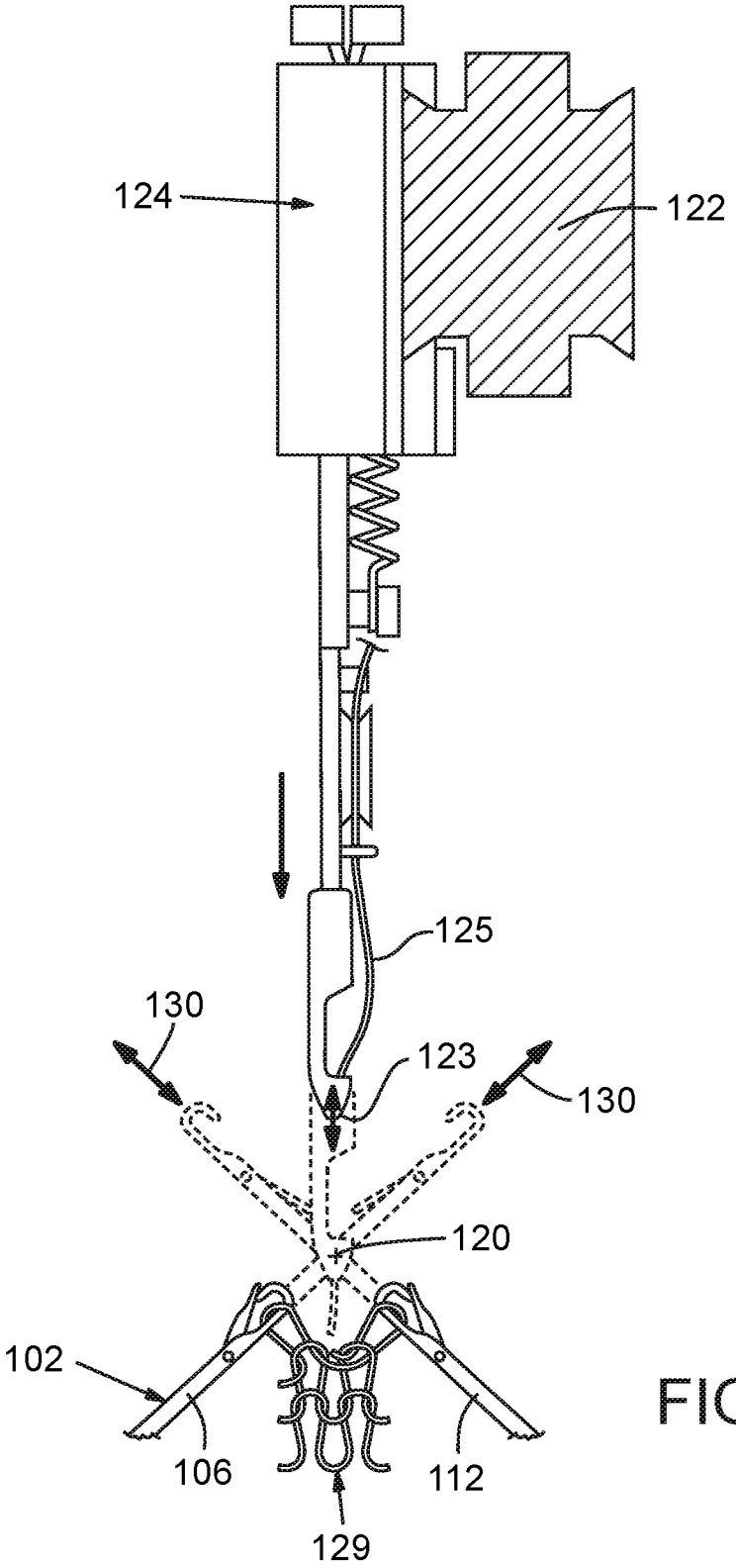
FIG. 5 is an end view of needles and a yarn feeder of the knitting machine illustrating a knitting process according to exemplary embodiments of the present disclosure.

Needles 102 can receive yarn 125 and can perform various knitting procedures for incorporating yarn 125 into a knitted component 129 as represented in FIGS. 4 and 5. For example, needles 102 can knit, tuck, float, inlay, or otherwise manipulate yarn 125 to form knitted component 129.

Needles 102 can be configured to move relative to intersection 120 and relative to other needles 102 within the respective bed. For example, as shown in FIG. 5, needles 102 can be configured to move between a retracted position and an extended position. Needles 102 are shown in the retracted position with solid lines and in the extended position with broken lines in FIG. 5. In the retracted position, needle 102 can be spaced apart from intersection 120. In the extended position, needle 102 can be extended through intersection 120. This movement of needles 102 can be substantially linear as represented by arrows 130 in FIG. 5.

In some embodiments, in addition to moving along the longitudinal direction 121, feeder 124 can be configured to move relative to needles 102 between a retracted position and an extended position. In the embodiment of FIG. 5, feeder 124 is shown in the retracted position with solid lines, and feeder 124 is shown in the extended position with broken lines. In the retracted position, an end 123 of feeder 124 can be disposed above the intersection 120 in some embodiments. In the extended position, end 123 of feeder 124 can be disposed below the intersection 120. Also, while in the extended position, feeder 124 can feed yarn 125 toward needles 102 to be inlaid within knitted component 129 as represented in FIG. 4. In contrast, when in the retracted position, feeder 124 can feed yarn 125 toward needles 102 to form loops, tucks, floats, or other features of knitted component 129. Additionally, feeder 124 and other features of knitting machine 100 can be configured according to the teachings of U.S. Pat. No. 8,522,577, which issued on Sep. 3, 2013, and which is incorporated by reference in its entirety.

It will be appreciated that, in other embodiments, feeder 124 can have a single, fixed position relative to intersection 120. For example, in some embodiments, feeder 124 can remain above the intersection 120 as feeder 124 moves in the longitudinal direction 121 of knitting machine 100. Also, in some embodiments, feeder 124 can remain below the intersection 120 as feeder 124 moves in the longitudinal direction 121 of knitting machine 100.

Referring now to FIGS. 6-9 embodiments of sinkers 104 will be discussed generally according to exemplary embodiments. Sinkers 104 can be supported on knitting machine 100 for movement relative to other features of knitting machine 100. For example, sinker 104 can be configured to move between an open position and a closed position. The open position can also be referred to as a "retracted position," and the closed position can also be referred to as an "extended position." Sinker 104 is shown in the open position in FIG. 7 according to some embodiments. Sinker 104 is shown in the closed position in FIG. 9 according to some embodiments. Additionally, sinker 104 is shown in an intermediate position in FIG. 8. Moreover, in FIG. 6, first sinker 108 of first bed 110 is shown in the closed position while second sinker 114 of second bed 116 is shown in the open position.

It will be appreciated that sinker 104 and its movement, as illustrated in FIGS. 6-9 and as discussed in detail below, merely represents exemplary embodiments. Thus, sinker 104 can vary from these embodiments without departing from the scope of the present disclosure.

In some embodiments, sinker 104 can generally include a yarn engaging surface 141. Yarn engaging surface 141 can be disposed proximate to the gap 118 that is defined between first bed 110 and second bed 116. Yarn engaging surface 141 can move as sinker moves between the open position and the closed position. In some embodiments, movement of yarn engaging surface 141 can be substantially rotational (i.e., angular) as represented by arrow 178 in FIGS. 6-9.

As a result of this movement, yarn engaging surface 141 can move relative to the gap 118. For example, yarn engaging surface 141 can be disposed closer to gap 118 and, in some embodiments, disposed within gap 118 when sinker 104 is in the closed position (see FIGS. 6 and 9). In contrast, yarn engaging surface 141 can be disposed further from gap 118 and, in some embodiments, disposed outside gap 118 when sinker 104 is in the open position. Stated differently, yarn engaging surface 141 can be disposed closer to a center of the gap 118 in the closed position, and yarn engaging surface 141 can be spaced apart from the center of the gap 118 in the open position.

Figure 6:
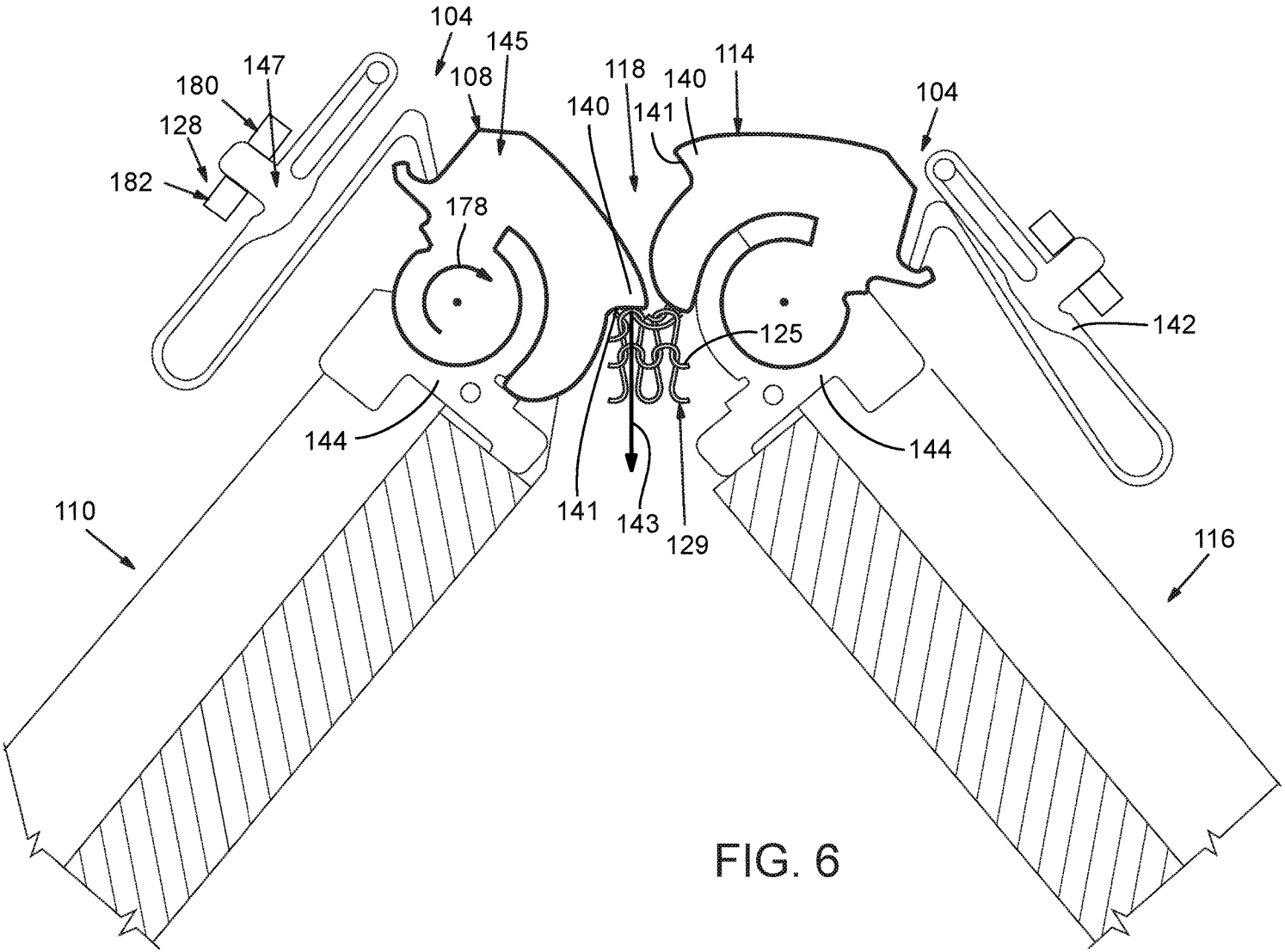
FIG. 6 is a section view of the knitting machine of FIG. 1 showing sinkers according to exemplary embodiments of the present disclosure.

As will be discussed, this movement of sinker 104 can occur during the knitting process. For example, as shown in FIG. 6, yarn engaging surface 141 of sinker 104 can push downward or otherwise engage the yarn 125 of knitted component 129 as sinker 104 moves toward the closed position. This pushing action is represented by arrow 143 in FIG. 6. In some embodiments, this operation of sinker 104 can occur in tandem with the movement of the needles 102 to perform the knitting process. Thus, sinkers 104 can perform known loop formation, hold-down, knock-over, or other functions as knitted component 129 is formed.

Knitting machine 100 can further including a sinker actuator system 127 for actuating sinkers 104 between the open position and the closed position. Actuator system 127 can include one or more cams, electric motors, pneumatic or hydraulic actuators, or other devices that actuate sinkers 104.

For example, in the illustrated embodiments, actuator system 127 can include a cam assembly 128. Cam assembly 128 is indicated schematically in FIGS. 1 and 2 and is described in detail below according to exemplary embodiments.

Cam assembly 128 can be supported by a carriage 126 as shown in FIG. 1. Carriage 126 can be supported by rail 122 and can move along rail 122, substantially parallel to the longitudinal direction 121. As carriage 126 moves along rail 122, cam assembly 128 can actuate predetermined ones of the sinkers 104. Also, in some embodiments, cam assembly 128 can include components for actuating predetermined ones of the needles 102. Moreover, in some embodiments, carriage 126 can move along rail 122 and a drive bolt or other similar structure can engage feeder 124 to move feeder 124 in the longitudinal direction 121 over first and second beds 110, 116.

Figure 12:
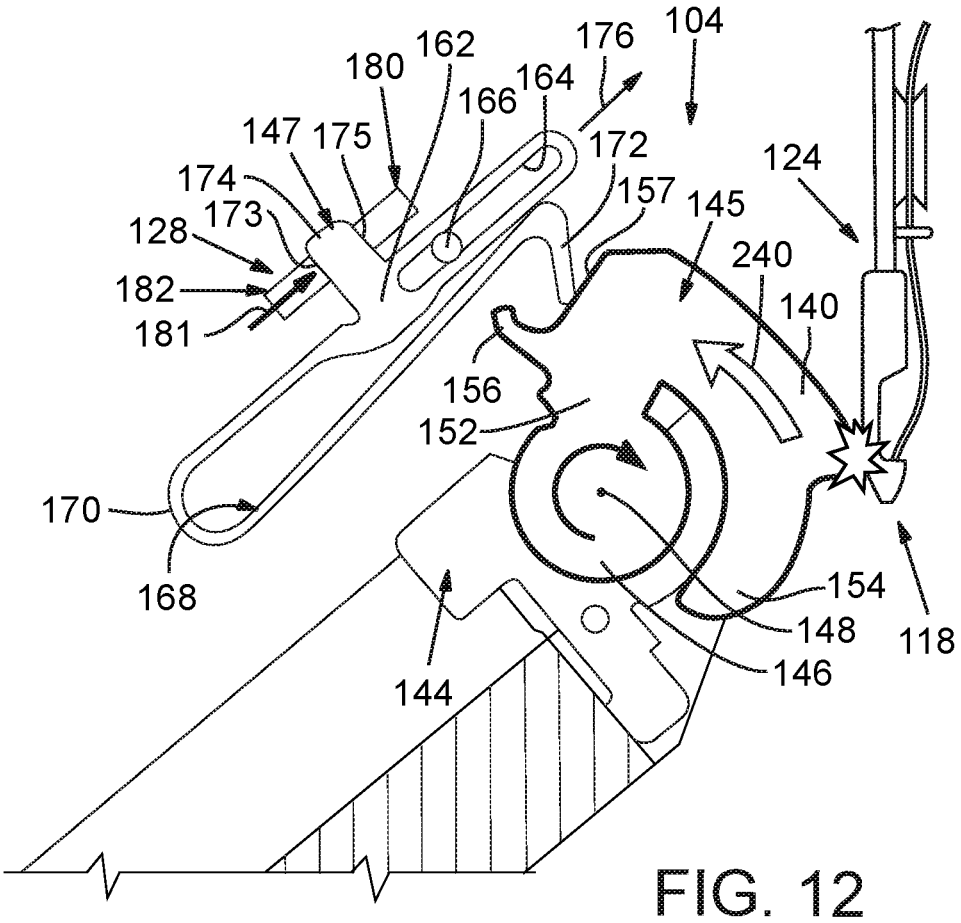
FIG. 12 is a section view of the knitting machine of FIG. 1 showing the representative sinker impacting a feeder.

During some operations of knitting machine 100, sinker 104 may receive a relatively high force (i.e., an input load) from something other than cam assembly 128. For example, sinker 104 can be impacted by another object as sinker 104 moves from the open position toward the closed position. In some embodiments, sinker 104 can impact feeder 124 as sinker 104 moves toward the closed position as represented in FIG. 12. This impact force can transfer from sinker 104 to the cam assembly 128.

As will be discussed, cam assembly 128 can include one or more features that allow sinker 104 to move back toward the open position as a result of the input load. For example, cam assembly 128 can include "break-away" features that allow sinker 104 to move toward the open position when sinker 104 receives an input load that exceeds a predetermined threshold. As such, cam assembly 128 can absorb and dampen forces from sinker 104 and also allow sinker 104 to move more freely under some conditions.

Embodiments of Sinker

Figure 7:
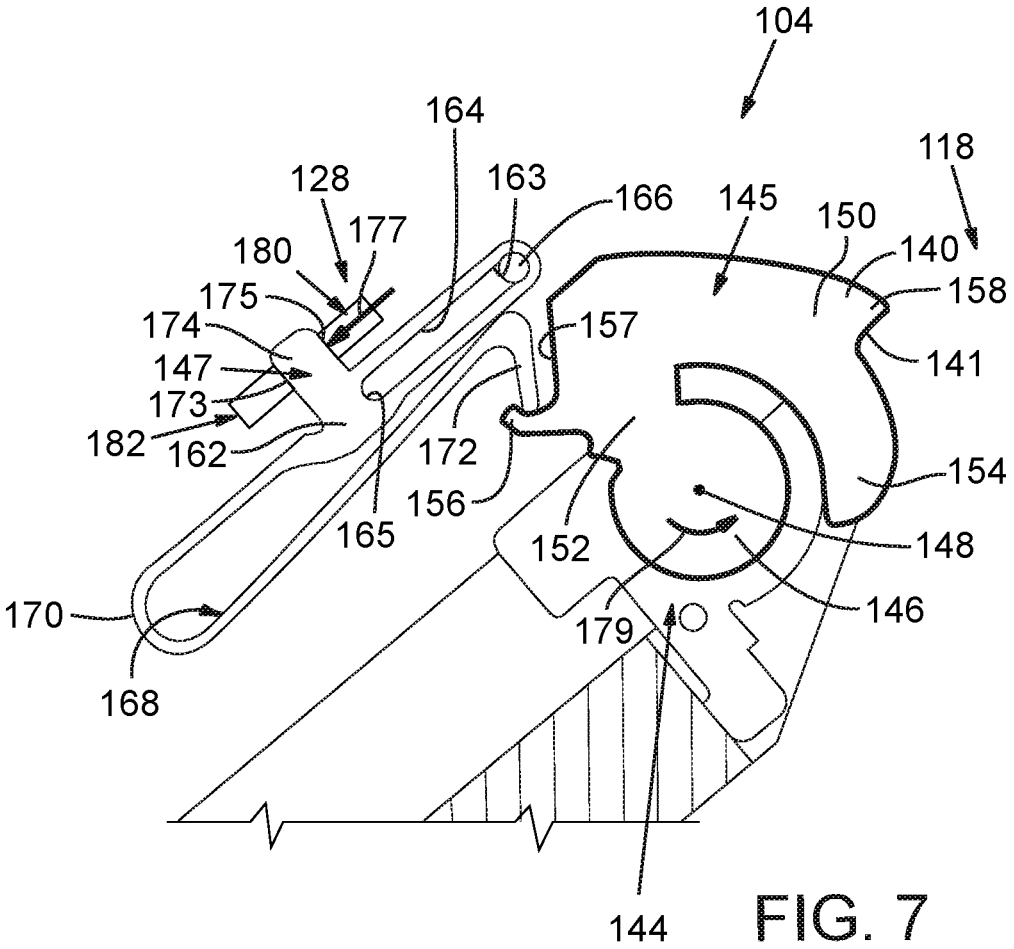
FIG. 7 is a section view of the knitting machine of FIG. 1 showing a representative sinker in an open position.
Figure 8:
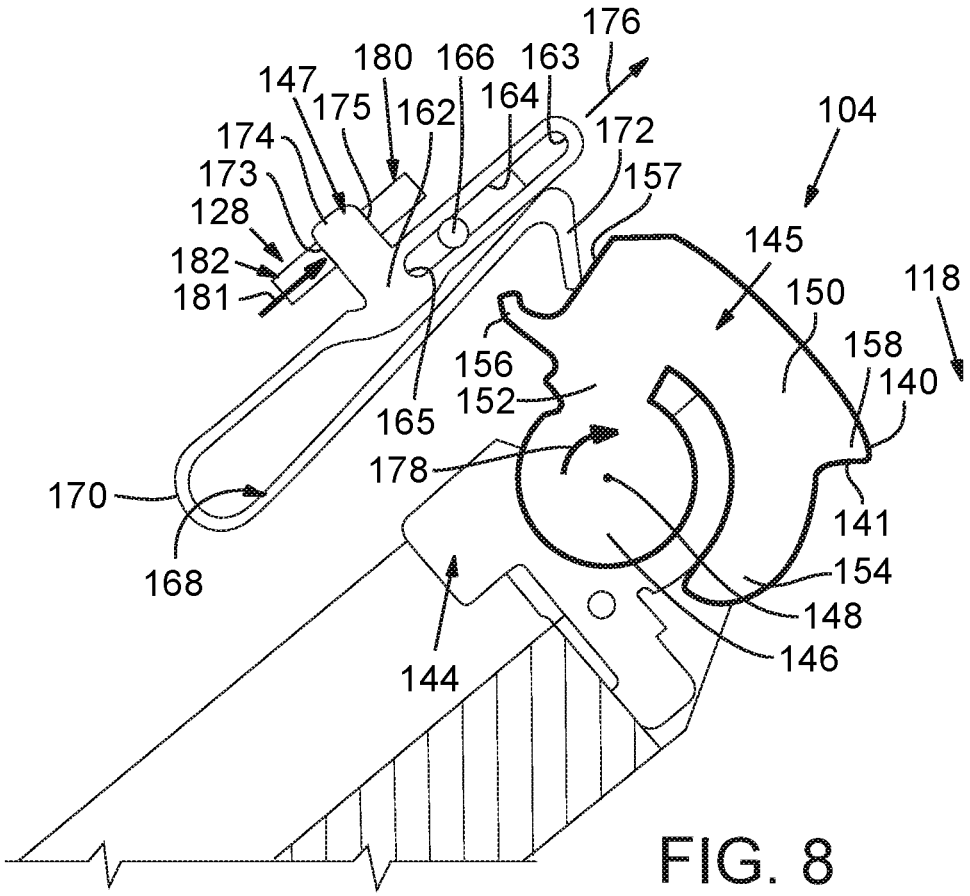
FIG. 8 is a section view of the knitting machine of FIG. 1 showing the representative sinker in an intermediate position.
Figure 9:
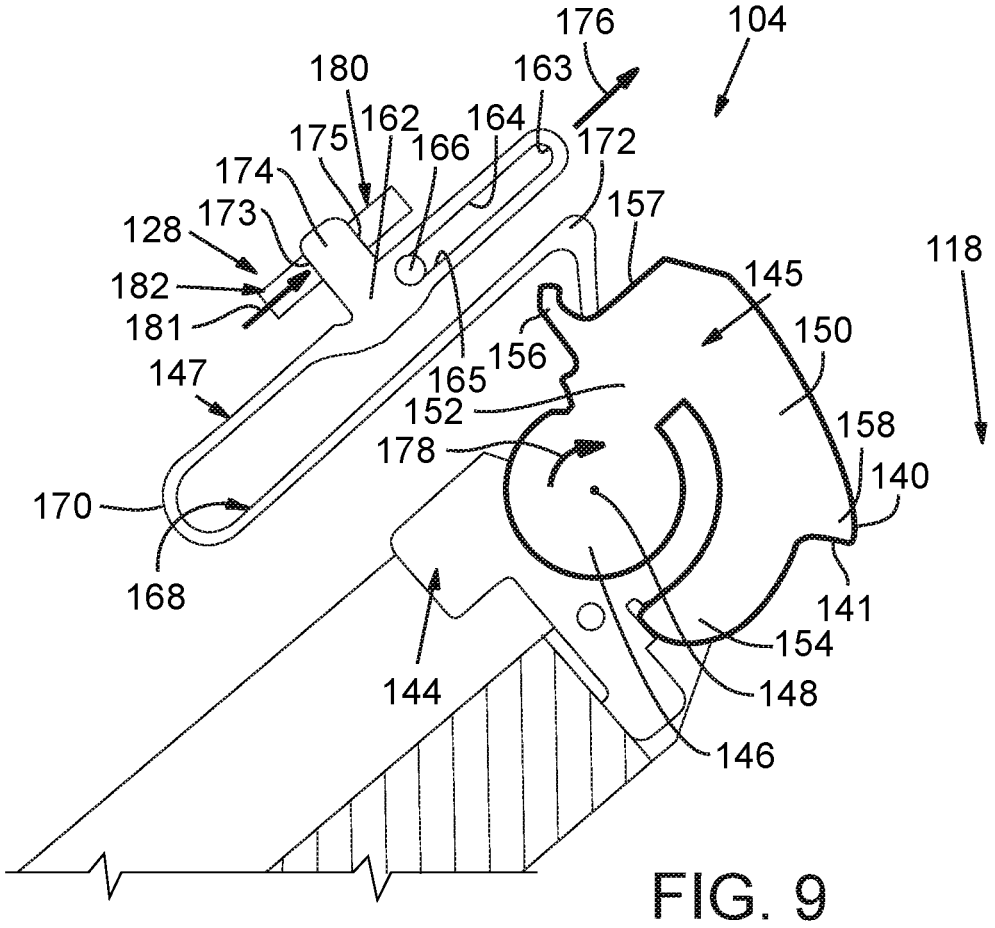
FIG. 9 is a section view of the knitting machine of FIG. 1 showing the representative sinker in a closed position.

Referring now to FIGS. 7-9, exemplary embodiments of sinker 104 will be discussed in greater detail. It will be appreciated that other sinkers 104 of knitting machine 100 can correspond to the embodiments illustrated in FIGS. 7-9 and described below. It will also be appreciated that sinkers 104 can vary from these embodiments without departing from the scope of the present disclosure.

Generally, sinker 104 can include a first member 145, a second member 147, and support structure 144. In some embodiments, support structure 144 can be fixed to surrounding structures of knitting machine 100. First member 145 and/or second member 147 can be attached and supported by support structure 144. Also, first member 145 and/or second member 147 can move relative to support structure 144 as sinker 104 moves between the open position and the closed position.

First member 145 can include a rounded base 146 in some embodiments. Base 146 can be attached to the support structure 144 via a pivot joint 148.

Also, first member 145 can include an arm 150 with a first end 152 and a second end 154. First end 152 can be attached to base 146 and can project radially outward from base 146. Arm 150 can curve circumferentially about base 146. Second end 154 can be disposed proximate to the gap 118 between first needle bed 110 and second needle bed 116.

First member 145 can also include a hook 156 in some embodiments. Hook 156 can project and curve outwardly from arm 150 and can be disposed proximate first end 152.

Additionally, first member 145 of sinker 104 can include an outer abutment surface 157. Abutment surface 157 can be defined partially on hook 156 and on an outer area of arm 150 that is proximate hook 156. Abutment surface 157 can engage second member 147 of sinker 104 as will be discussed.

Moreover, first member 145 can define a head 140. In some embodiments, head 140 can project radially outwardly from arm 150. Head 140 can include yarn engaging surface 141, which is configured to engage the knitted component 129 as shown in FIG. 6.

Second member 147 of sinker 104 can include a base 162. Base 162 can include an elongate slot 164. Slot 164 can be axially straight in some embodiments. Also, slot 164 can receive a post 166 of the support structure 144.

Furthermore, in some embodiments, second member 147 can include an arm 168. Arm 168 can extend from base 162 and can be curved in some embodiments. More specifically, arm 168 can extend from base 162 in a direction away from first member 145, and arm 168 can curve at a rear end 170 back toward first member 145 of sinker 104. Additionally, in some embodiments, arm 168 can terminate at a hook end 172. Hook end 172 can abut and engage surface 157 of first member 145. Arm 168 can be flexible and resilient in some embodiments. For example, arm 168 can flex to vary the distance between hook end 172 and base 162. This flexibility can ensure engagement between hook end 172 and surface 157 of first member 145 during movement of sinker 104.

Second member 147 can further include a butt 174 that projects from base 146 in a direction generally away from arm 168. In some embodiments, butt 174 can be disposed generally between slot 164 and rear end 170 of arm 168. Butt 174 can include a first surface 173 and a second surface 175. First surface 173 and second surface 175 can face in opposite directions from each other. First and second surfaces 173, 175 of butt 174 can abut and engage cam assembly 128 for moving sinker 104 between the open position and the closed position as will be discussed.

Movement of sinker 104 from open position of FIG. 7 to closed position of FIG. 9 will now be discussed. As shown in FIG. 7, cam assembly 128 can apply a force to second surface 175 of butt 174 as represented by arrow 177. As a result, second member 147 can be pushed such that post 166 slides toward a first end 163 of slot 164, and hook end 172 pulls back on hook 156 of first member 145. First member 145 can, in turn, rotate in a counter-clockwise direction as viewed in FIG. 7 and as indicated by arrow 179.

To move from the open position toward the closed position, cam assembly 128 can apply a force to first surface 173 of butt 174 as represented by arrow 181 in FIGS. 8 and 9. As a result, second member 147 can be pushed such that post 166 slides toward a second end 165 of slot 164, and hook end 172 can push against surface 157 of first member 145. First member 145 can, in turn, rotate in a clockwise direction as viewed in FIGS. 8 and 9 and as indicated by arrow 178.

Then, sinker 104 can move back toward the open position when cam assembly 128 applies the force to second surface 173 of butt 174 as represented in FIG. 7. It will be appreciated, then, that this movement of first and second members 145, 147 of sinker 104 can be reciprocal.

Moreover, second member 147 can move substantially in a linear direction (i.e., move along a substantially linear path) as sinker 104 moves between the open position and the closed position. This linear movement can be guided due to abutment and sliding of post 166 within slot 164. Thus, second member 147 can be referred to as a "linear actuation member" of sinker 104 in some embodiments.

In contrast, first member 145 can rotate about pivot joint 148 and can move along a substantially angular path as sinker 104 moves between the open position and the closed position. Thus, first member 145 can be referred to as a "rotational actuation member" member of sinker 104 in some embodiments.

As mentioned above, sinker 104 can be actuated between the closed position and the open position by an actuator system 127, such as a cam assembly 128. Cam assembly 128 is shown in detail according to exemplary embodiments in FIGS. 10 and 11. Generally, components of cam assembly 128 can have predetermined dimensions and shapes. Also, these components can have predetermined positions within knitting machine 100. Cam assembly 128 can also have surfaces that engage corresponding parts of the sinkers 104. By engaging sinker 104, cam assembly can push, pull, or otherwise actuate sinker 104 between the open position (FIG. 7) and the closed position (FIG. 9).

Cam assembly 128 can be mounted for movement relative to sinkers 104. For example, cam assembly 128 can be supported by carriage 126. As carriage 126 moves, cam assembly 128 can engage and actuate predetermined ones of the sinkers 104 between the open position and the closed position.

Thus, cam assembly 128 can transfer forces to the sinker 104 for moving the sinker 104. In some cases, however, sinker 104 can transfer forces to the cam assembly 128, which causes cam assembly 128 to move from a first position to a second position. As such, cam assembly 128 can absorb and dampen forces from sinker 104 and also allow sinker 104 to move more freely under some conditions. This can, in turn, allow for a wider range of uses of the knitting machine 100 and allow new types of knitted components to be produced.

Embodiments of Cam Assembly

Figure 10:
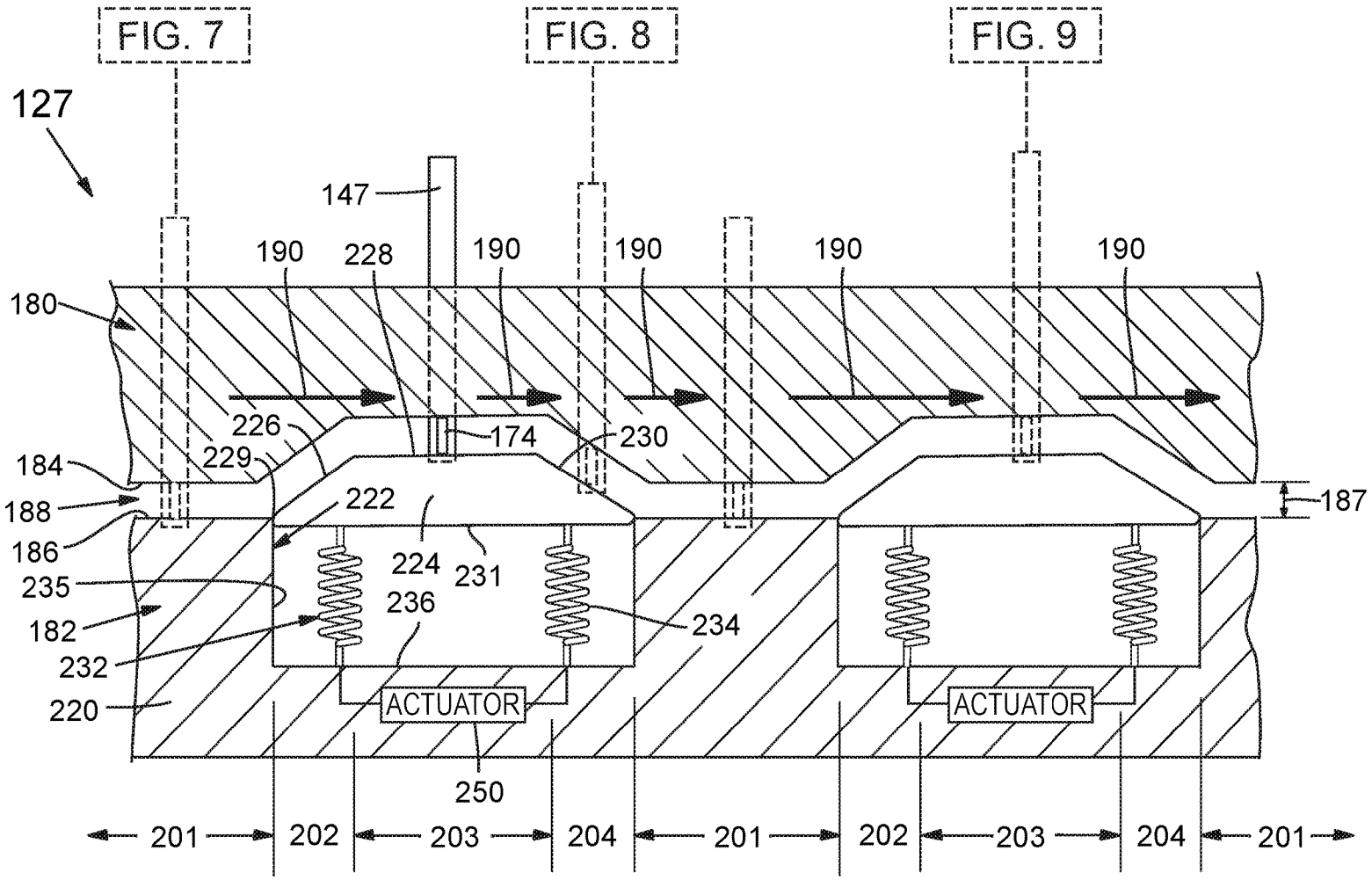
FIG. 10 is a schematic section view of a cam assembly that actuates the sinker of FIGS. 7-9 between the open position and the closed position.
Figure 11:
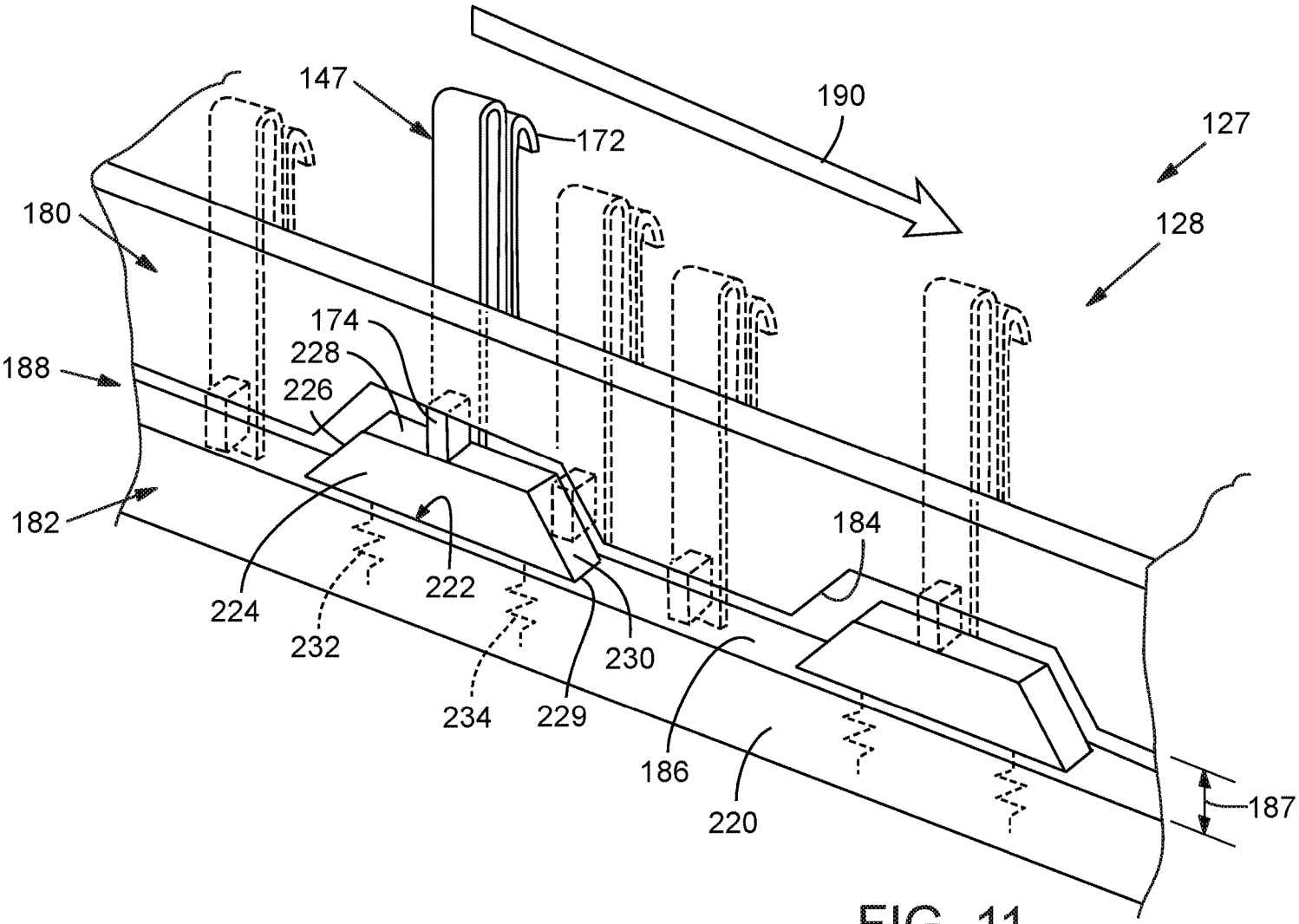
FIG. 11 is a schematic perspective view of the cam assembly of FIG. 10.

As shown in FIGS. 10 and 11, cam assembly 128 can generally include a first cam member 180 and a second cam member 182. First cam member 180 can include a first cam surface 184, and second cam member 182 can include a second cam surface 186.

First and second cam members 180, 182 can be spaced apart at a distance 187. In other words, first and second surfaces 184, 186 can define a track 188 having a width that is equal to the distance 187 indicated in FIGS. 10 and 11. Distance 187 can be approximately equal to the width of butt 174 of second member 147 of sinker 104. As such, track 188 can receive the butt 174 as cam assembly 128 moves over butt 174. First and second surfaces 184, 186 can engage and push butt 174 to actuate sinker 104.

It is noted that although FIGS. 10 and 11 are illustrated such that butt 174 appears to move along track 188 in the direction of arrows 190, this is merely for simplicity. In reality, carriage 126 rides over sinker 104 causing track to receive butt 174. First and second surfaces 184, 186 push butt 174 toward and away from gap 118 defined between first and second beds 110, 116 of knitting machine 100. As a result, second member 147 rotates first member 145 between the open position and the closed position.

It will be appreciated that first and second surfaces 184, 186 defining track 188 can be shaped, sized, and arranged in a wide variety of ways without departing from the scope of the present disclosure. FIG. 10 illustrates an exemplary embodiment. Moving from left to right, track 188 can include a lower level segment 201, which leads to an ascending segment 202. Next, track 188 can include an upper level segment 203, which leads to a descending segment 204, and back to another lower level segment 201. In this configuration, sinker 104 can be in the open position shown in FIG. 7 when butt 174 is moving within lower level segment 201. Sinker 104 can be in the intermediate position, similar to FIG. 8, when moving within the ascending segment 202. Sinker 104 can be in the closed position of FIG. 9 when in the upper level segment 203. Then, sinker 104 can move back to the intermediate position of when moving in the descending segment 204, then to the open position when moving in the next lower level segment 201, and so on.

It will be appreciated that second cam surface 186 can abut and push butt 174 of sinker 104 as butt 174 travels in the ascending segment 202 to move sinker 104 toward the closed position. Also, it will be appreciated that first cam surface 184 can abut and push butt 174 of sinker 104 as butt 174 travels in the descending segment 204 to move sinker 104 toward the open position.

In some embodiments, first cam member 180 can be a unitary member such that portions of track 188 defined by first cam surface 184 are substantially fixed.

Also, in some embodiments, second cam member 182 can include a support structure 220 with one or more openings 222. For example, as shown in FIG. 10, support structure 220 can include two openings 222 that are spaced apart along track 188. In some embodiments, support structure 220 can define lower level segments 201 of track 188. Openings 22 can be disposed in ascending segment 202, upper level segment 203, and descending segment 204.

Second cam member 182 can also include one or more biased cam members 224. Biased cam member 224 can be received within opening 222. Thus, in the embodiment of FIG. 10, two biased cam members 224 are shown, and each biased cam member 224 is received within a respective opening 222.

Biased cam members 224 can include an ascending surface 226, a plateau surface 228, and a descending surface 230. Plateau surface 228 can extend between ascending surface 226 and descending surface 230. Biased cam members 224 can further include a peripheral side 229 and an underside 231. Peripheral side 229 can extend about a lower periphery of cam member 224, for example, at the outer periphery of underside 231. Also, underside 231 can face the bottom 236 of opening 222.

When attached to support structure 220, biased cam member 224 can cooperate to define track 188. For example, ascending surface 226 and first cam surface 184 can cooperate to define ascending segment 202 of track 188. Plateau surface 228 and first cam surface 184 can cooperate to define upper level segment 203 of track 188. Descending surface 230 and first cam surface 184 can cooperate to define descending segment 204.

Figure 13:
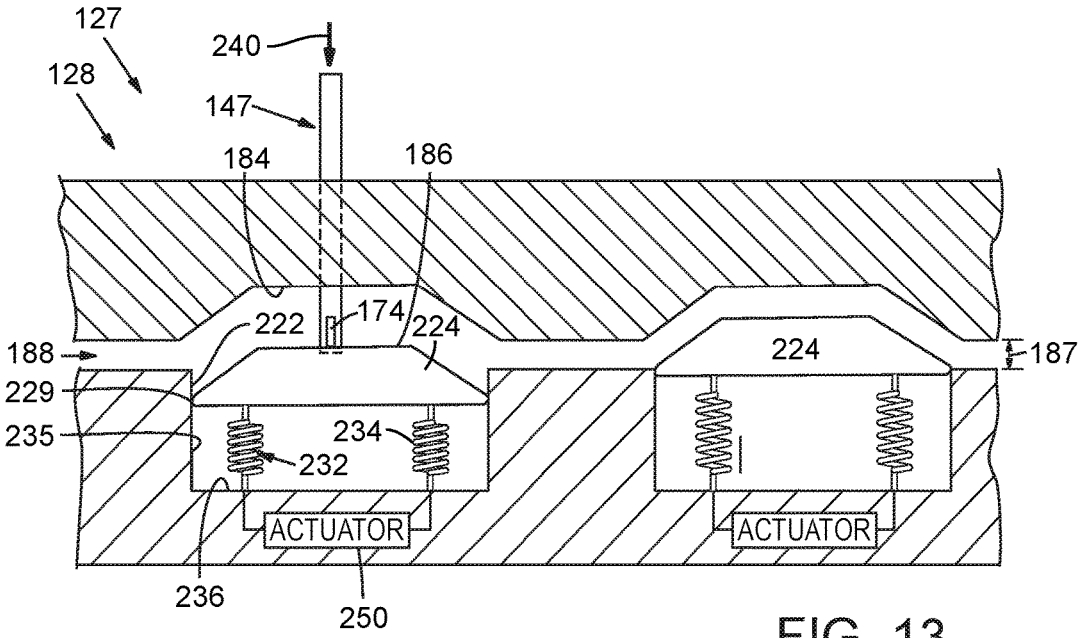
FIG. 13 is a schematic section view of the cam assembly, where a cam member is shown being pushed as a result of the impact of FIG. 12.
Figure 14:
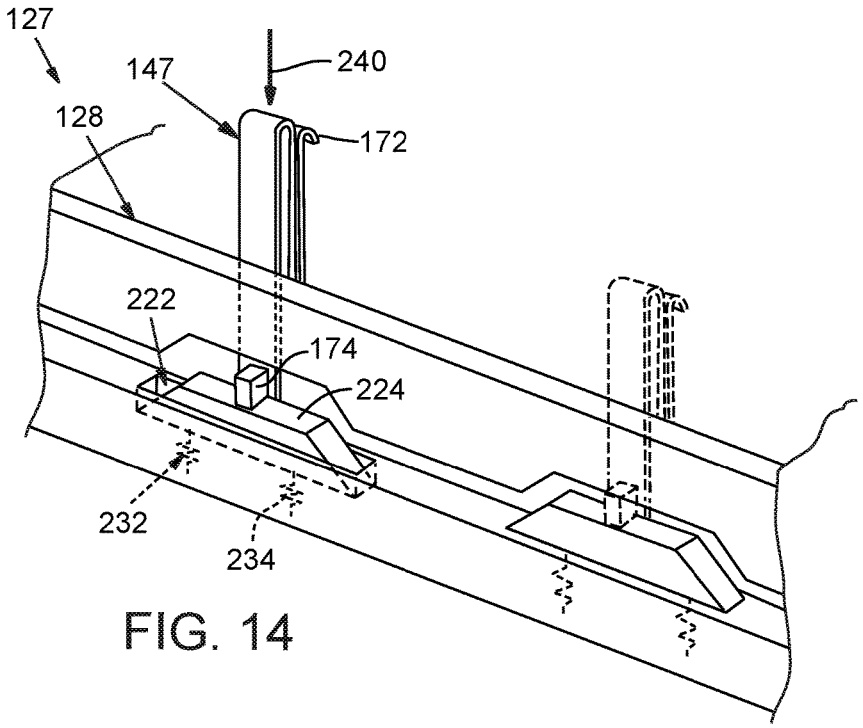
FIG. 14 is a schematic perspective view of the cam assembly of FIG. 13.

In some embodiments, the size of opening 222 can correspond to the size of biased cam member 224. Thus, biased cam member 224 can move into and out of opening 222 between a first position and a second position. FIGS. 10 and 11 show biased cam member 224 in a first position, substantially extended out of opening 222 according to exemplary embodiments. In contrast, FIGS. 13 and 14 show biased cam member 224 in a second position, substantially recessed into opening 222 according to exemplary embodiments.

Additionally, in some embodiments, sides 235 of opening 222 can be proximate to the peripheral side 229 of biased cam member 224. Also, sides 235 and/or structures supported by sides 235 can engage biased cam member 224 to guide movement of biased cam member 224 into and out of opening 222. For example, in some embodiments, peripheral side 229 of biased cam member 224 can abut and slide along sides 235 of opening 222 when moving between the first position (FIGS. 10 and 11) and the second position (FIGS. 13 and 14). Additionally, in some embodiments, support structure 220 and biased cam member 224 can have interlocking sliders, tongue-and-groove attachments, or other types of couplings that support this sliding movement.

Also, second cam member 182 can include one or more biasing members 232. In some embodiments, biasing members 232 can be helical compression springs 234. However, it will be appreciated that biasing members 232 could include hydraulic springs, leaf springs, pneumatic springs, or other types of biasing members. Biasing members 232 can be attached at one end to the bottom 236 of opening 222 and attached at the opposite end to the underside 231 of the biased cam member 224.

It will also be appreciated that cam assembly 128 can include any number of biasing members 232. In the illustrated embodiments, for example, each biased cam member 224 is supported by two respective biasing members 232.

Moreover, biasing members 232 can bias cam member 224 toward the first position represented in FIGS. 10 and 11. Biasing members 232 can have a predetermined spring constant for providing a predetermined level of biasing force to cam member 224.

Accordingly, as butt 174 of sinker 104 moves within track 188 as represented in FIGS. 10 and 11, cam assembly 128 can actuate sinker 104 between the open position and the closed position. This is explained in detail above according to exemplary embodiments. Assuming that any reaction forces transferred from the sinker 104 to the biased cam members 224 are less than the biasing force provided by biasing members 232, the biased cam members 224 will remain in the first position causing sinkers 104 to reciprocate between the open and closed positions.

However, under certain conditions, an input load can be applied to sinker 104, and sinker 104 can transfer this load to cam assembly 128. For example, FIG. 12 shows a condition in which sinker 104 impacts the yarn feeder 124. Specifically, the cam assembly 128 is shown pushing upward on the butt 174 of the second sinker member 147, causing the first sinker member 145 to rotate into the gap 118 toward its closed position. However, the feeder 124 happens to be in the way, and the head 140 of the first sinker member 145 impacts the feeder 124. As such, the feeder 124 imparts a resulting reaction force onto the first sinker member 145. This reaction force can be referred to as an input force imparted to the first sinker member 145, which is represented by arrow 240.

The input force 240 can be transferred from the first sinker member 145 to the second sinker member 147 as represented in FIGS. 13 and 14. As shown, the input force 240 can cause second sinker member 147 to push downward on biased cam member 224, against the biasing force supplied by biasing member 232.

As a result, biased cam member 224 can recess into opening 222. Stated differently, the input force 240 can cause biased cam member 224 to move away from the first position (FIGS. 10 and 11) toward the second position (FIGS. 13 and 14). Also, the distance 187 of track 188 measured between first cam surface 184 and second cam surface 186 of cam member 224 can increase as cam member 224 moves toward the second position. As a result, cam assembly 128 releases sinker 104 and allows sinker 104 to move away from its closed position (FIG. 9), back toward its open position (FIG. 7).

Once the input force 240 is reduced, biasing member 232 can bias cam member 224 back toward the first position (FIGS. 10 and 11). For example, once carriage 126 and cam assembly 128 bypasses sinker 104, the input force 240 can be reduced on cam member 224 to allow cam member 224 to bias back toward the first position.

Biasing member 232 can provide a predetermined threshold biasing force that biases cam member 224 toward the first position. If the input force 240 resulting from the impact with feeder 124 exceeds the predetermined threshold force, then biased cam member 224 can recess into opening 222 toward its second position. However, if the input force 240 is below the threshold, then cam member 224 can remain in its first position. It will be appreciated that the predetermined threshold force can be selected to allow the biased cam member 224 to move to the second position under the influence of relatively high loads, such as when impacting the feeder 124. However, the threshold can be high enough to retain the biased cam member 224 in the first position under the influence of lower loads, such as during normal knitting operations.

Also, in some embodiments, the threshold force provided by biasing member 232 can be varied between a first threshold force and a second threshold force. For example, the biasing member 232 can have a variable stiffness. Also, in some embodiments, the cam assembly 128 can include an actuator 250 that is operably connected to the biasing member 232. The actuator 250 is represented schematically in FIGS. 10 and 13. It will be appreciated that the actuator 250 can be an electric motor, a pneumatic actuator, a hydraulic actuator, or another type of actuator. The actuator 250 can be configured to actuate to vary the threshold biasing force provided by the biasing member 232. For example, in some embodiments, the actuator 250 can actuate to change the length of the biasing member 232 to vary the threshold force. Accordingly, in some embodiments, the user can actuate the actuator 250 and increase the threshold biasing force when desired. Alternatively, the user can actuate the actuator 250 to decrease the threshold biasing force when desired.

In summary, the cam assembly 128 of the knitting machine 100 can actuate the sinkers 104 in an efficient and effective manner for facilitating the knitting process. However, if the sinkers encounter excessive resistance when moving toward the closed position, the cam assembly 128 can allow the sinker 104 to move back toward the open position. For example, if the knitted component 129 is pushing back on the sinker 104 an excessive amount, the cam assembly 128 can give way and allow the sinker 104 to move back toward the open position. Also, if the sinker 104 impacts the feeder 124 when moving toward the closed position, the sinker 104 can push back on the cam assembly 128. The cam assembly 128 can, in turn, allow the sinker 104 to move back toward the open position. Also, cam assembly 128 can absorb and dampen forces from sinker 104. Additionally, in some embodiments, the feeder 124 can remain within the gap 118 below the intersection 120 of the beds 110, 116 of the knitting machine 100. Accordingly, the feeder 124 can be used in a wide variety of positions relative to the beds 110, 116 of the knitting machine 100.

Embodiments with a Ramped Surface

Figure 15:
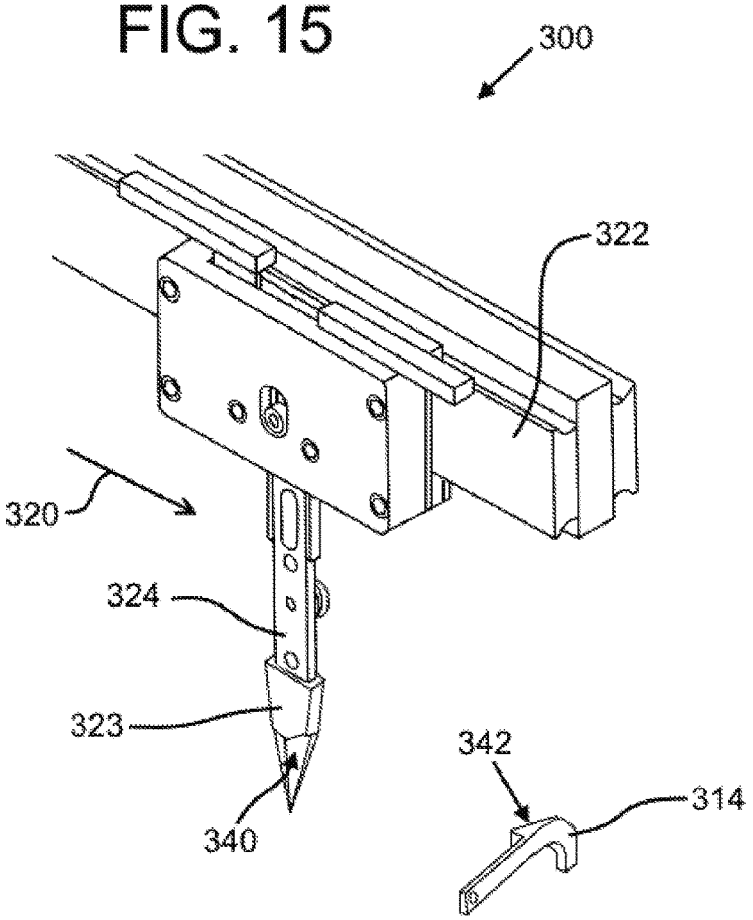
FIG. 15 is a perspective view of a feeder and sinker of a knitting machine, where the feeder and sinker have ramped surfaces.

Referring to FIG. 15, a knitting machine 300 may include a feeder 324 and/or a sinker 314 with a surface shaped to facilitate movement of the sinker from the closed position to the open position when the feeder 324 impacts the sinker 314. For example, the feeder 324 may include an end portion 323 with a first ramped surface 340. The first ramped surface 340 may correspond with a second ramped surface 342 on the sinker 314. As described in detail above, in some instances, when the feeder 324 moves in the feed direction 320 along the rail 322, it may impact the sinker 314. The feeder 324 and/or the sinker 314 may be configured such that when this impact occurs, the first ramped surface 340 of the feeder 324 contacts the second ramped surface 342 of the sinker 314. The ramped surfaces 340 and 342 may be shaped or otherwise configured such that the contact between the ramped surfaces 340 and 342 creates an input force that initiates a movement of either the feeder 324 and/or the sinker 314 to allow the feeder 324 to bypass the sinker 314. This may prevent damaging the components of the knitting machine 300 and may allow the feeder 324 to continue its motion in the feed direction 320.

Figure 16:
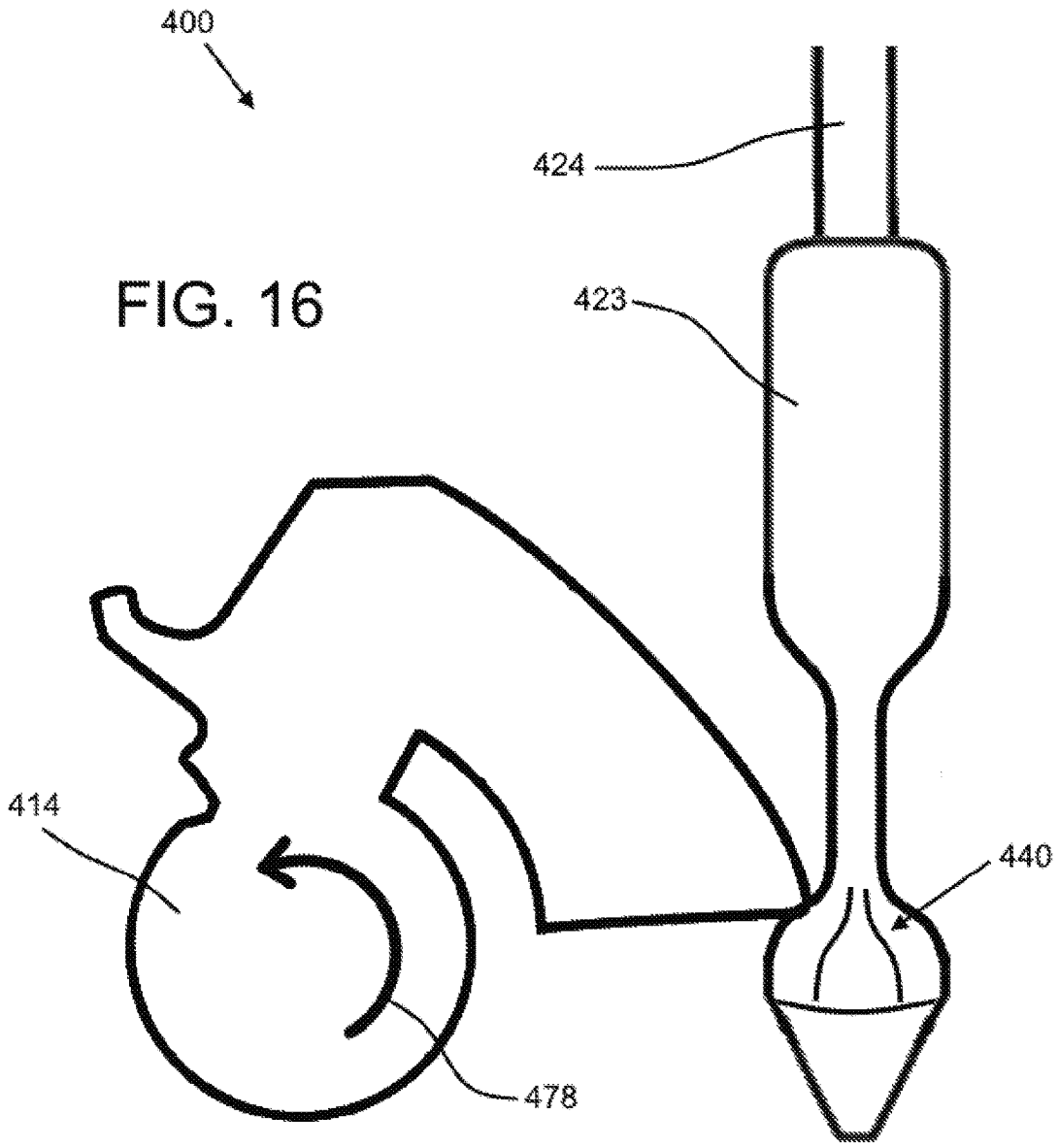
FIG. 16 is a section view of a knitting machine showing a feeder and a sinker, where the feeder has a ramped surface.

In some embodiments, including the embodiment of a knitting machine 400 depicted in FIG. 16, a feeder 424 may include an end portion 423 with a ramped surface 440, which here is a curved ramped surface circumnavigating the end portion 423. The ramped surface 440 may be located such that when the feeder 424 impacts the sinker 414, the ramped surface 440 contacts the sinker 414. The ramped surface may be configured such that contact between the feeder 424 the sinker 414, which may be a conventional off-the-shelf sinker not specifically designed to have a ramped surface, causes the sinker 414 to rotate in a direction as indicated by arrow 478 to an open position, thereby preventing damage to the sinker 414 and/or the feeder 424 and allowing the feeder 424 to pass. Advantageously, the ramped surface 440 of the feeder 424 may extend around substantially the entirety of the end portion 423 to correspond to sinkers located on multiple sides of the feeder 424 and such that any rotation of the feeder 424 along its longitudinal axis will not misalign the ramped surface 440 with the sinker 414. In other embodiments, the sinker 414 may alternatively or additionally include a ramped surface configured to cause rotation of the sinker 414 in the direction indicated by arrow 478, while the feeder 424 may be a conventional off-the-shelf feeder not specifically designed to have a ramped surface. It is contemplated that the feeder 424 and/or the sinker 414 may additionally or alternatively include an attachment having a ramped surface.

Embodiments with a ramped surface on the feeder and/or the sinker are particularly advantageous when the knitting machine 400 includes a biasing member (e.g., biasing member 232 of FIG. 10). A biasing member may provide a predetermined level of biasing force to the sinker 414 in the clockwise direction (e.g., towards a closed position as described in detail above with reference to FIG. 10). In this embodiment, when an impact occurs between the feeder 424 and the sinker 414, the ramped surface 440 will contact the sinker 414. The resulting reaction force may be sufficient to overcome the biasing force, thereby causing the sinker 414 to rotate in the counterclockwise direction (indicated by arrow 478) such that that the feeder 424 can bypass the sinker 414. After the feeder 424 bypasses the sinker 414, the biasing force provided by the biasing member may then cause clockwise motion of the sinker 414 to move it back into the closed position such that the sinker 414 continues to perform the desired function.

While various embodiments of the present disclosure have been described, the description is intended to be exemplary, rather than limiting, and it will be apparent to those of ordinary skill in the art that many more embodiments and implementations are possible that are within the scope of the present disclosure. Accordingly, the present disclosure is not to be restricted except in light of the attached claims and their equivalents. Also, various modifications and changes may be made within the scope of the attached claims.

I claim:

1. A knitting machine comprising:

a sinker configured to move between an open position and a closed position; and a sinker actuator system having a first configuration and a second configuration, wherein the sinker actuator system, in the first configuration, actuates the sinker from the open position toward the closed position, wherein the sinker is configured to change the sinker actuator system from the first configuration to the second configuration when the sinker receives an input force above a predetermined threshold when moving from the open position toward the closed position, wherein the sinker actuator system, in the second configuration, allows the sinker to move away from the closed position toward the open position, and wherein the knitting machine further comprises a yarn feeder, wherein a first ramped surface of the yarn feeder is configured to contact the sinker to provide the input force when the sinker impacts the yarn feeder.

2. The knitting machine of claim 1, wherein the sinker actuator system includes a cam assembly comprising:

a cam member that is movable between a first position and a second position; and a biasing member that biases the cam member toward the first position with a predetermined threshold force, wherein the cam member is in the first position when the sinker actuator system is in the first configuration, wherein the cam member is in the second position when the sinker actuator system is in the second configuration, wherein the cam member, in the first position, moves relative to the sinker to actuate the sinker away from the open position toward the closed position, and wherein the cam member is configured to receive the input force from the sinker that moves the cam member away from the first position to the second position when the input force exceeds the predetermined threshold force, thereby allowing the sinker to move away from the closed position toward the open position.

3. The knitting machine of claim 1, wherein the sinker comprises a second ramped surface configured to contact the yarn feeder when the sinker impacts the yarn feeder.

4. A knitting machine for knitting a knitted component comprising:

a sinker movable between an open position and a closed position; and a sinker cam assembly for actuating the sinker to move the sinker between the open position and the closed position, the sinker cam assembly including:

a cam member movable between a first position and a second position; and a biasing member that biases the cam member toward the first position with a predetermined threshold force, wherein the cam member, in the first position, is configured to move relative to the sinker to actuate the sinker away from the open position toward the closed position, wherein the cam member is configured to receive an input force from the sinker that moves the cam member away from the first position to the second position when the input force exceeds the predetermined threshold force, thereby allowing the sinker to move away from the closed position toward the open position, and wherein the knitting machine further comprises a yarn feeder, wherein a first ramped surface of the yarn feeder is configured to contact the sinker to provide the input force when the sinker impacts the yarn feeder.

5. The knitting machine of claim 4, wherein the sinker comprises a second ramped surface configured to contact the yarn feeder when the sinker impacts the yarn feeder.

6. The knitting machine of claim 4, wherein the cam member is a first cam member that at least partly defines a first cam surface of the sinker cam assembly, wherein the sinker cam assembly includes a second cam member that at least partly defines a second cam surface of the sinker cam assembly, wherein the first cam surface is spaced apart from the second cam surface to define a track between the first cam surface and the second cam surface, wherein the track has a width measured between the first cam surface and the second cam surface, and wherein the width of the track at a location proximate to the first cam member changes as the first cam member moves between the first position and the second position.

7. The knitting machine of claim 6, wherein the first cam surface is configured to abut against the sinker and actuate the sinker away from the open position toward the closed position, and wherein the second cam surface is configured to abut against the sinker and actuate the sinker away from the closed position toward the open position.

8. The knitting machine of claim 4, further comprising:

a first needle bed with a plurality of first needles that are arranged substantially within a first plane; and a second needle bed with a plurality of second needles that are arranged substantially within a second plane, wherein the first plane and the second plane intersect at an intersection, wherein a first zone is defined above the intersection and a second zone is defined below the intersection, wherein the yarn feeder is configured to move within the second zone relative to the first and second needle beds, and wherein the sinker is configured to impact the yarn feeder and translate the input force to the cam member as a result of the impact.

9. The knitting machine of claim 4, wherein the predetermined threshold force is adjustable between a first threshold force and a second threshold force.

10. The knitting machine of claim 9, further comprising an actuator configured to actuate to adjust the threshold force of the biasing member between the first threshold force and the second threshold force.

11. The knitting machine of claim 4, wherein the sinker includes a first member and a second member, wherein the first member includes a yarn engaging surface that is configured to contact the knitted component, and wherein the cam member, in the first position, is configured to abut the second member and actuate the second member, which actuates the first member and moves the yarn engaging surface.

12. The knitting machine of claim 11, wherein the second member is configured to move along a substantially linear path as the sinker moves between the open position and the closed position, and wherein the first member is configured to move along a substantially angular path as the sinker moves between the open position and the closed position.

13. The knitting machine of claim 4, wherein the cam member is supported by a support structure, wherein the cam member moves relative to the support structure when moving between the first position and the second position, and wherein the biasing member is attached to the support structure and the cam member.

14. The knitting machine of claim 13, wherein the support structure includes an opening, and wherein the cam member is configured to retract into the opening as the cam member moves away from the first position toward the second position.

15. The knitting machine of claim 14, wherein the cam member is configured to slide into the opening as the cam member moves away from the first position toward the second position.

16. The knitting machine of claim 4, wherein the biasing member includes a helical compression spring.

* * * * *